United States Patent [19]

Colin

[11] Patent Number: 4,482,272

[45] Date of Patent: Nov. 13, 1984

[54] LOAD TRANSFER AND MONITORING SYSTEM FOR USE WITH JACKUP BARGES

[75] Inventor: Jean P. Colin, New Orleans, La.

[73] Assignee: Ateliers et Chantiers de Bretagne acb, France

[21] Appl. No.: 371,305

[22] Filed: Apr. 23, 1982

[51] Int. Cl.[3] ..... E02B 17/08; C21D 1/44

[52] U.S. Cl. ..... 405/198; 405/196; 267/121

[58] Field of Search ..... 405/115, 195, 196, 198–201, 405/211, 212, 215, 289; 254/93 HP; 248/631; 267/118, 121, 122

[56] References Cited

U.S. PATENT DOCUMENTS

| | | | |
|---|---|---|---|
| 2,076,071 | 4/1937 | Bolt | 248/631 |
| 2,673,064 | 3/1954 | Patterson | 405/196 X |
| 3,503,600 | 3/1970 | Rich | 405/212 X |
| 3,584,464 | 6/1971 | Saadeh | 405/215 |
| 3,667,707 | 6/1972 | Mui | 267/122 X |
| 3,986,368 | 10/1976 | Levingston | 405/196 |
| 4,007,914 | 2/1977 | Sutton | 405/198 X |
| 4,029,305 | 6/1977 | Schubert | 267/121 X |
| 4,148,518 | 4/1979 | Vilbeuf | 248/631 X |

FOREIGN PATENT DOCUMENTS

| | | | |
|---|---|---|---|
| 85723 | 6/1980 | Japan | 405/196 |
| 773282 | 10/1980 | U.S.S.R. | 405/289 |

*Primary Examiner*—Cornelius J. Husar
*Assistant Examiner*—Nancy J. Stodola
*Attorney, Agent, or Firm*—Charles Garvey

[57] ABSTRACT

A load transfer apparatus for jackup barges provides a barge and at least three legs movably attached to the barge with a jacking mechanism associated respectively with each of the legs for vertically moving the legs with respect to the barge. A hydraulic pad is associated with each of the jacking mechanism and is placed between the jacking mechanism and the barge, forming a load transfer and load monitoring interface between the jacking mechanism and the barge. The pad includes preferably a hollow inflatable steel reinforced rubber pad which is pressurized during operation using suitable hydraulic fluid. The apparatus reduces impact load on the platform structure when the legs first touch bottom and might also be used to pre-load the legs using the hydraulic pads instead of ballast. The apparatus can be additionally used to monitor the load carried by each leg and to balance the loads among the legs, as well as to dampen vibrations.

32 Claims, 9 Drawing Figures

LOAD TRANSFER AND MONITORING SYSTEM FOR USE WITH JACKUP BARGES

BACKGROUND OF THE INVENTION

1. Field of the Invention

The present invention relates to marine structures such as jackup rigs, jackup barges, jackup platforms, and the like and more particularly relates to an improved load transfer system for jackup rigs having a barge and a plurality of support legs which are vertically movable in order to raise the platform from a floating position on the surface of the ocean to a stable position with the legs at their lowermost end bearing on the seabed.

Even more particularly, the present invention relates to a shock absorbing, load monitoring and load transfer system using a substantially frictionless hydraulic component, which system has the capability of distributing the load within the overall platform support system making the loading configuration a statically determinate problem as opposed to a normally statically indeterminate case with platform having four or more legs, for example.

2. General Background

In the offshore oil and gas drilling industry, for example, and with oil/gas wells which have already been drilled and are producing, a method used to provide a barge or working platform above the well often involves the use of a barge which is raised above the surface of the water and above the flotation provided by the ocean to a level thereabove wherein three or more legs bear at their lower end portion on the seabed and thus support the rig barge or platform in a stable fashion thereabove.

There are numerous "jackup platforms" in use in the world, many for the above-mentioned offshore drilling or production purposes, and some for offshore well logging and maintenance and the like. Others are used for various other types of offshore work such as dredging, mining, harbor construction, and some are involved in bridge construction and/or civil engineering purposes. Many of these platforms have need for a load monitoring device which can tell the operators of the rig the respective loads being carried by each of the many legs which support it.

A load monitoring device using strain gauges is available on the market and is one of the systems which has been used consistently to monitor load on jackup rig legs.

The jacking mechanism of some platforms consists of hydraulic jacks. Such jacks are disclosed in various U.S. patents such as U.S. Pat. Nos. 2,540,679; and 4,040,265. With such hydraulic jacking mechanisms it is possible to have an idea of the weight of the platform during the jacking operation by monitoring the pressure on the hydraulic jacks. However, the mechanical friction between several components such as the piston-cylinder, piston rod-rod end bottom, legs-leg guides, prevents any accurate weighing of the platform during the jacking operation. Once the platform is jacked up, the jacking mechanism is locked for several reasons. It is rather dangerous to rely on the piston seals of these type jacking mechanisms to keep the platform in position for a very long period of time. Further, when the jacking mechanism is locked up it becomes impossible to determine the weight of the platform and the load distribution on the legs.

There are on most platforms large variation in weights and positions of the variable load. This is very critical on small cantilever type jackup drilling barges. Some owners of such platforms rely on computer calculations to determine the legs load but the computer calculations are only as good as the data they receive. Thus, if they receive wrong data the values for loads are useless.

Another type of jacking mechanism is provided with a rack and pinion arrangement. In this manner, the only way to estimate the jackup weight is to measure either the current in the electric systems (or the pressure delivered in the hydraulic motors) or the torque of one of the shafts in the mechanism driving the jacking operation. Again, due to friction, the results are inaccurate and the error is of the same order of magnitude as the variable load.

One system which has been patented in an attempt inter alia to approximate the weight of the platform or which could possibly be used to approximate the weight of a platform is described in U.S. Pat. No. 3,986,368 entitled "Load Equalizing and Shock Absorber System for Offshore Drilling Rigs" issued Oct. 19, 1976, to Clarence W. Levingston. However, this system cannot always be precise use of hydraulic cylinder assemblies and due to the friction of the piston and piston rods in these cylinders. Moreover, a leak in any of the cylinders can make the whole system inoperative. The presence of seals in these assemblies produces a source of failure upon wearing of the seal as can be enhanced by repetitive operation especially in the presence of shear loads.

3. General Discussion of the Present Invention

The present invention solves the prior art problems and shortcomings by providing a reliable, precise, robust load leg monitoring system which is also capable of improving the sharing of the load on the different legs of a platform. In addition, the system can reduce the impact load on a marine platform when the legs first touch bottom. Furthermore, the present invention provides a system which equalizes the load of the different jacking mechanisms of each of the legs. Also provided with the present invention is a short stroke jacking capacity.

It is thus an object of the present invention to provide a reliable, precise, robust leg load monitoring system for a jackup platform.

It is another object of the present invention to provide a load transfer and monitoring system for jackup legs which can determine a platform weight and the horizontal position of the center of gravity on the platform.

It is another object of the present invention to provide a means for improving the sharing of the load between the different legs of a jackup platform having four or more legs.

Another object of the present invention is to distribute evenly the load on one leg between several jacking mechanisms.

Still another object of the present invention is to provide a means of preloading the legs of the platform of a jackup rig having four or more legs without using ballast or adding any weight on the platform, thereby substantially reducing ballast space requirements.

Another important object of the present invention is to provide a jackup platform operator a single system to prevent overloading of one of the platform legs with all the possible consequences.

Another object of the present invention is to provide a load monitoring and transfer system for jackup rigs which absorbs shock transferred from the legs to the jacking structure and then the barge during raising or lowering of the legs.

Another object of the present invention is to provide a load monitoring and load transfer system for jackup rigs which is not disturbed with shear loads generated between the legs of the platform and the jacking structure.

Another object of the present invention is to provide a load monitoring and load transfer system for jackup rigs, which utilizes hydraulically actuated pads, and further allows continued operation of the apparatus when one of the pads becomes damaged by isolating it in the system.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 3A is a top fragmentary view of the jacking structure of FIG. 3;

FIG. 3B is a side sectional fragmentary view of the jacking structure of FIGS. 3, 3A;

DETAILED DESCRIPTION OF THE PRESENT INVENTION

Figure 1:
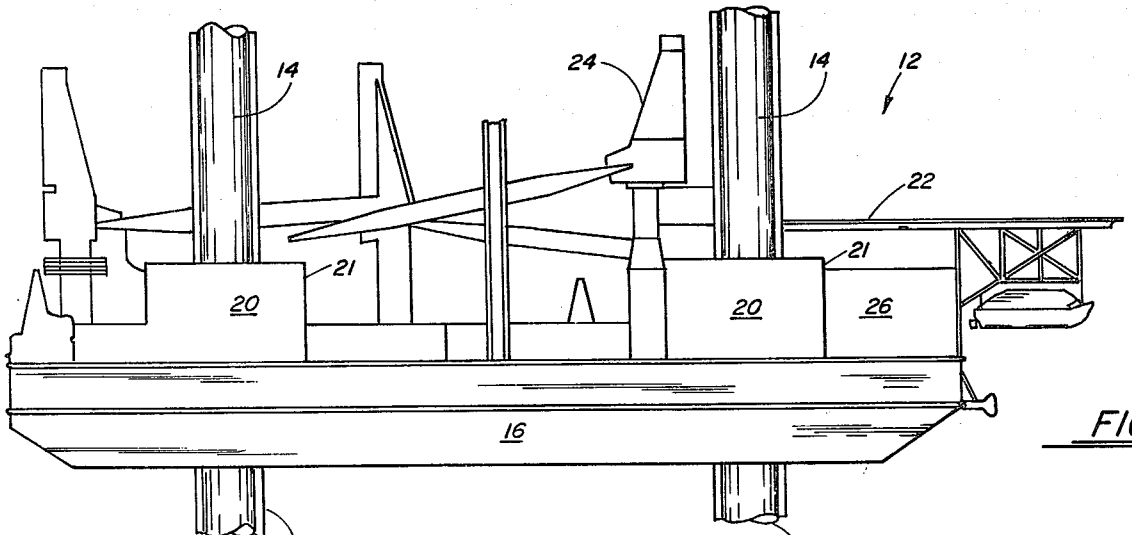
FIG. 1 is a side elevations view of a typical jackup rig of the type to which the present invention pertains.
Figure 2:
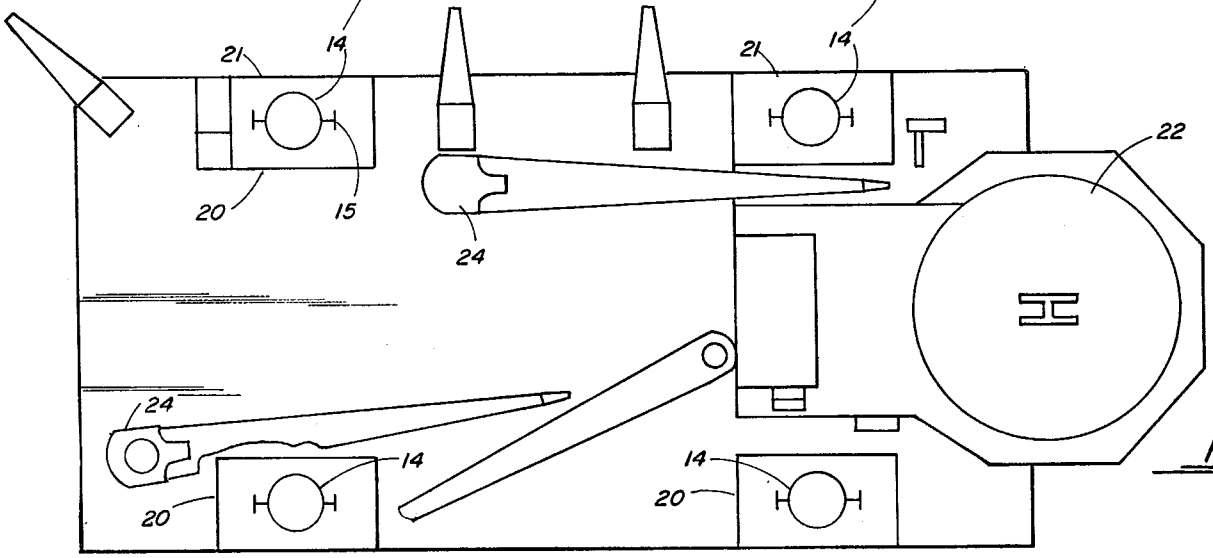
FIG. 2 is a top view of the jackup rig of FIG. 1.
Figure 4:
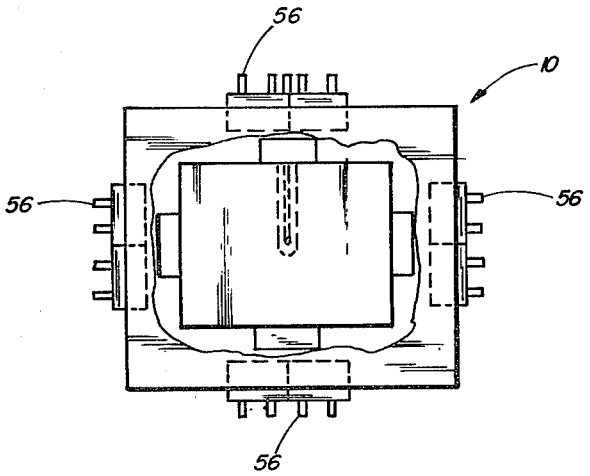
FIG. 4 is a fragmentary view of the preferred embodiment of the apparatus of the present invention.

FIGS. 1 and 2 in the drawings illustrate generally and for purposes of introduction to the invention field, a jackup rig designated generally by the numeral 12. Rig 12 provides one or more legs 14 which support a barge 16 structure. Upon the barge 16 are provided and associated with each of the legs a jacking mechanism designated generally by the numeral 20 in FIGS. 1 and 2. Each jacking mechanism 20 includes a structural jacking house 21 of concrete or steel and has associated therewith leg 14 and further provides a means for powering the leg to move with respect to barge 16 as during raising/lowering barge 16 with respect to the seabed. This mechanism can be a rack and pinion type mechanism with each leg 14 having a toothed rack 15 which engages a pinion gear (not shown) as powered by motors (usually electric or hydraulic) on the jacking unit 20. Such a rig 12 contains various other equipment such as a heliport 22, cranes 24, and crew quarters 26.

Figure 3:
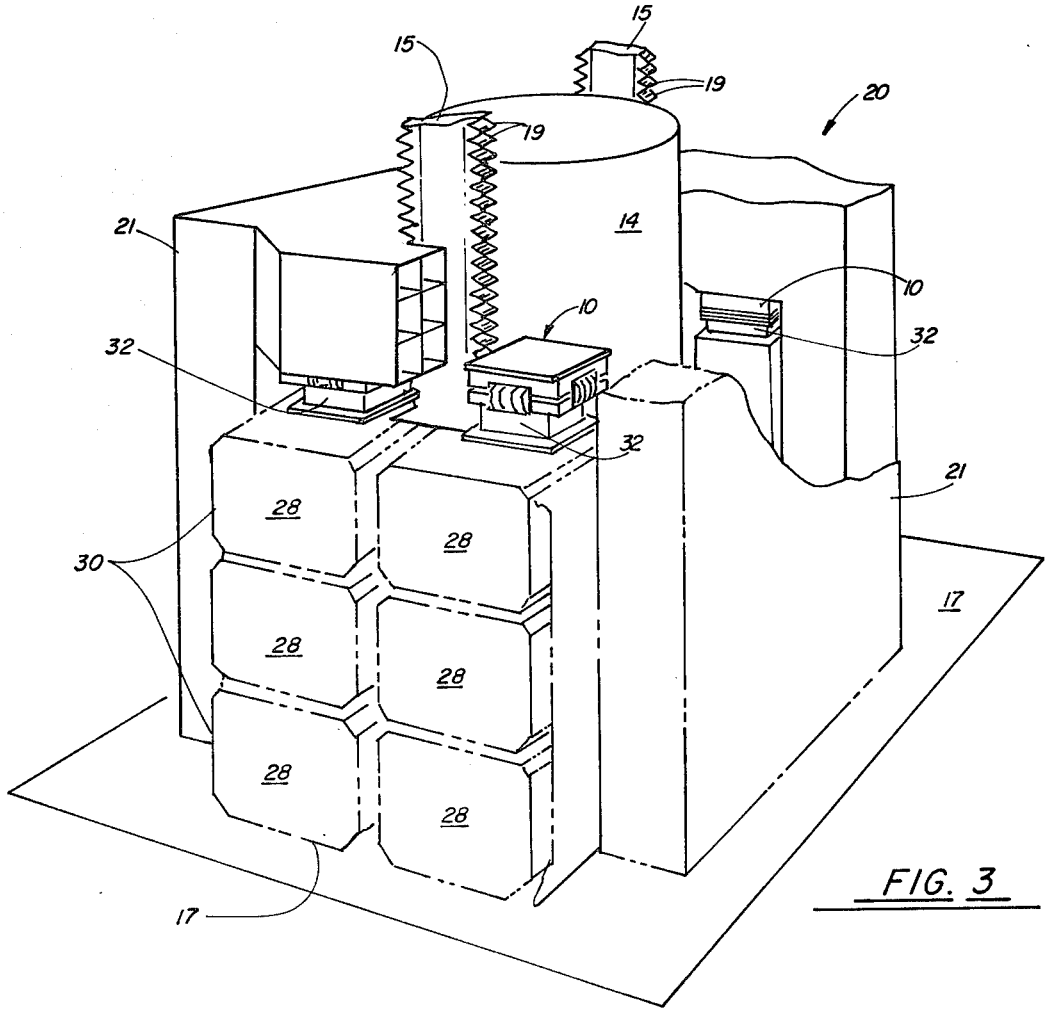
FIG. 3 is a perspective view of the preferred embodiment of the apparatus of the present invention illustrating the rig jacking structure and partially illustrating one of the rig legs.

Jacking mechanism 20 is shown more particularly in FIGS. 3, 3A and 3B. The barge 16 provides a deck 17 upon which jacking mechanism 20 is supported. Leg 14 is shown in FIG. 3 as having a pair of racks 15, each providing a plurality of teeth 19. Teeth 19 engage pinion gears P which are powered by, for example, electric motors 28 as shown in FIG. 3 through reduction gears. Each motor 28 would have an associated rotary shaft and the pinion gear attached thereto. In FIG. 3 notice that six motors are provided as exemplary with each rack 15 thus three pinion gears P would engage each rack 15 at the provided teeth 19.

The plurality of electric motors 28 and reduction gears form together a jacking assembly which is designated generally by the numeral 30 in FIG. 3. Jacking assembly 30 bottoms upon deck 17 and at its top portion is provided with load transfer apparatus 10 of the present invention as will be described more fully hereinafter. Between transfer apparatus 10 and jacking assembly 30 can be provided rubber cushions 32 of, for example, solid rubber if desired. Rubber cushions 32 could be sandwiched between steel plates or the like.

In FIGS. 4 through 8 there can be seen more particularly the load transfer apparatus of the present invention designated generally by the numeral 10.

Load transfer apparatus 10 provides a telescoping enclosure 40 having a lowermost static base plate 42 which is mounted upon mounting plate 44 atop rubber block 32. Rubber block 32 could also be provided with an upper steel plate 33, for example, forming an interface between the rubber block 32 and steel mounting plate 44.

Figure 8:
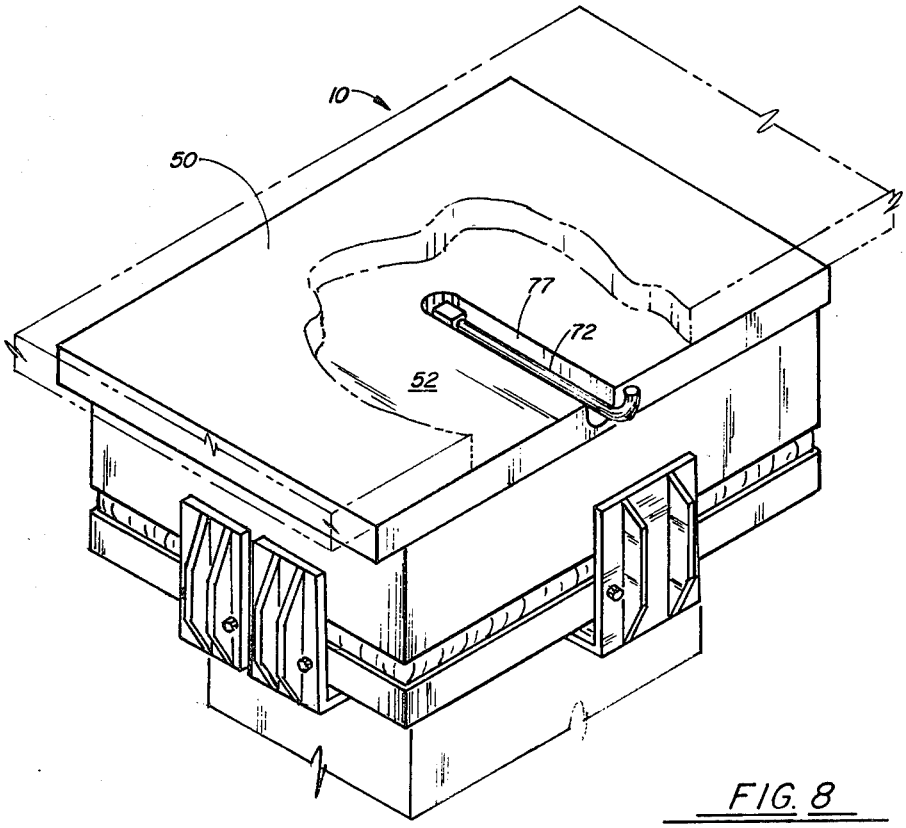
FIG. 8 is a perspective view of the preferred embodiment of the apparatus of the present invention.

Lowermost static section 42 supports thereabove a pad cover assembly 50 which comprises top 52 and sides 54. Gusseting 56 can also be provided for strengthening side wall 54. Generally L-shaped gusset plates 56 are bolted, for example, using bolted connection 58 to base plate 42 and provide indexing and alignment for cover assembly 50 as is best seen in FIG. 8. This holds cover assembly 50 in its proper position above base plate 42 as will be described more fully hereinafter.

A pressurizeable hollow hydraulic pad 60 which can be, for example, of steel reinforced rubber construction is also seen having steel reinforcement 62 and a rubber wall 61.

In order to prevent abrasiveness of pad 60 from dust entering the assembly, a flexible curtain 65 extends from bottom plate 42 upwardly and engages during operation the innermost face 66 of each side wall 54. This flexible curtain 65 extends or contracts responsive to movement of cover plate assembly 40 from a collapsed position as shown in FIG. 5 to an expanded position as shown in FIG. 6.

The hydraulic pad 60 is filled with a core to prevent, in case of a loss of pressure inside the said pad, the side walls of the assembly to be crushed by the external force. That core can be made of steel balls, glass beads or the like. It is preferred for corrosion and economics to use glass beads.

Figure 5:
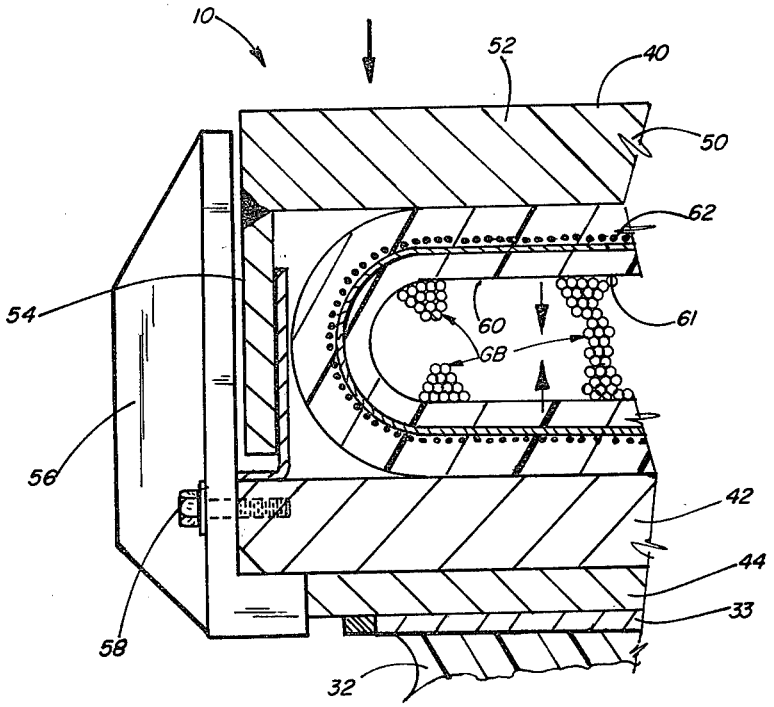
FIG. 5 is a sectional view of the preferred embodiment of the apparatus of the present invention in a collapsed position.
Figure 6:
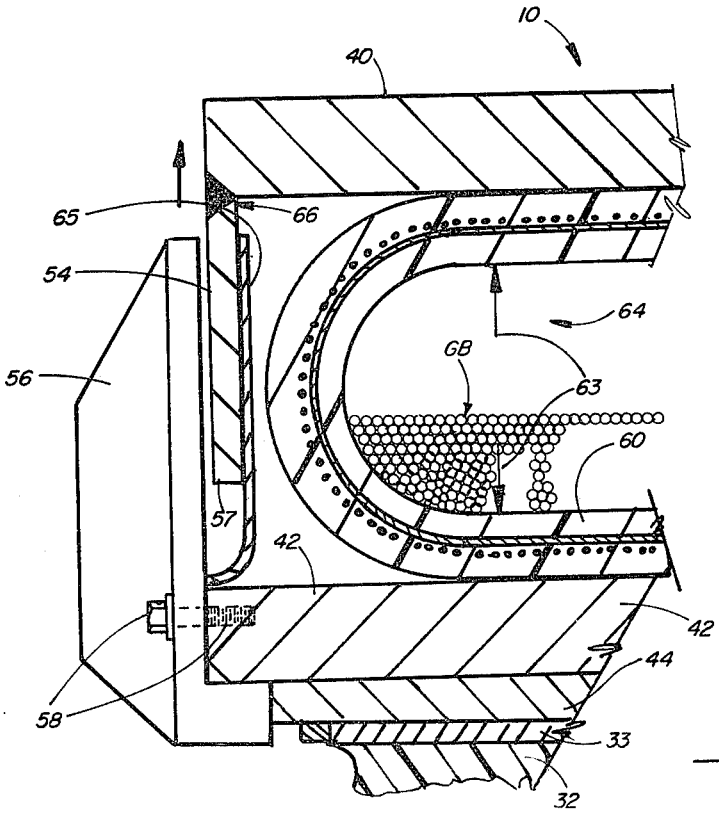
FIG. 6 is a sectional view illustrating the preferred embodiment of the apparatus of the present invention in a pressurized condition.

In FIG. 5, the arrows indicate collapsing of cover assembly 40 until the glass beads GB are fully compressed. A strainer prevents glass beads GB from leaving pad 60 and entering the hydraulic lines which transmit fluid thereto. In FIG. 6, the bottom edge 57 of side wall 54 is shown in an elevated position above base plate 42 responsive to the expansion of hydraulic fluid within the pad interior 64 with the arrows being designated by the numeral 63 in FIG. 6.

Figure 7:
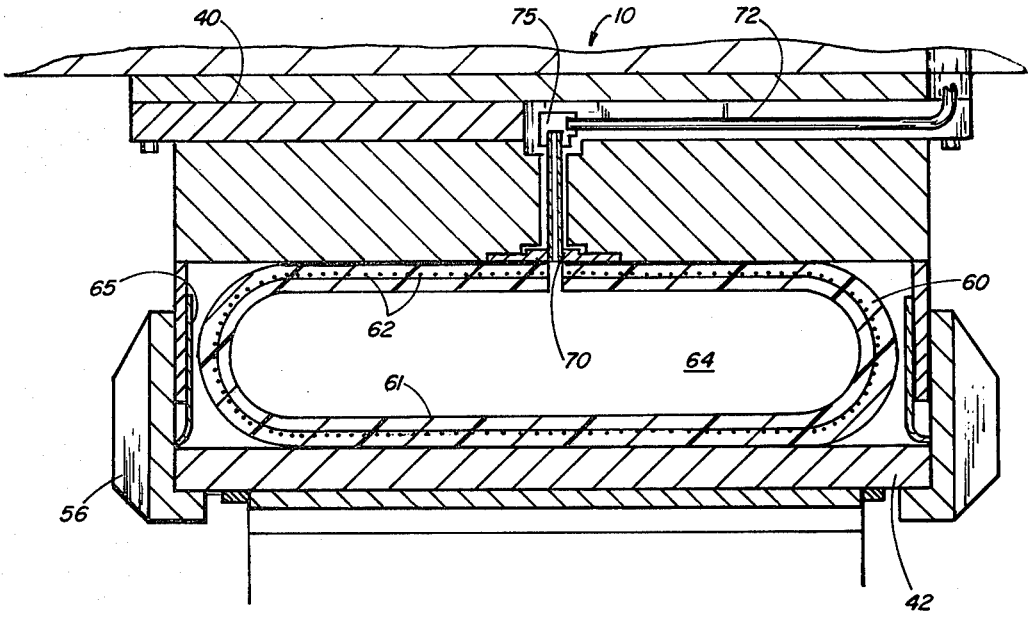
FIG. 7 is a side sectional view of the preferred embodiment of the apparatus of the present invention.

FIGS. 7–8 illustrate a means for supplying hydraulic fluid to pad 60 and the interior 64 portion thereof. A spigot 70 supplied with pad 60 at the uppermost portion thereof communicates with a conduit 72 which begins above spigot 70 connecting thereto then proceeds upwardly through cover assembly 40. An L-connection 75 is provided allowing conduit 72 to exit on the side of cover assembly 40. A groove 77 can be cut, for example, in top plate 52 allowing access to conduit 72 and maintenance thereof. An upper interface or shim plate 51 can be provided if desired with the jacking house 21 bearing against interface plate 51 as shown in FIG. 3.

Figure 9:
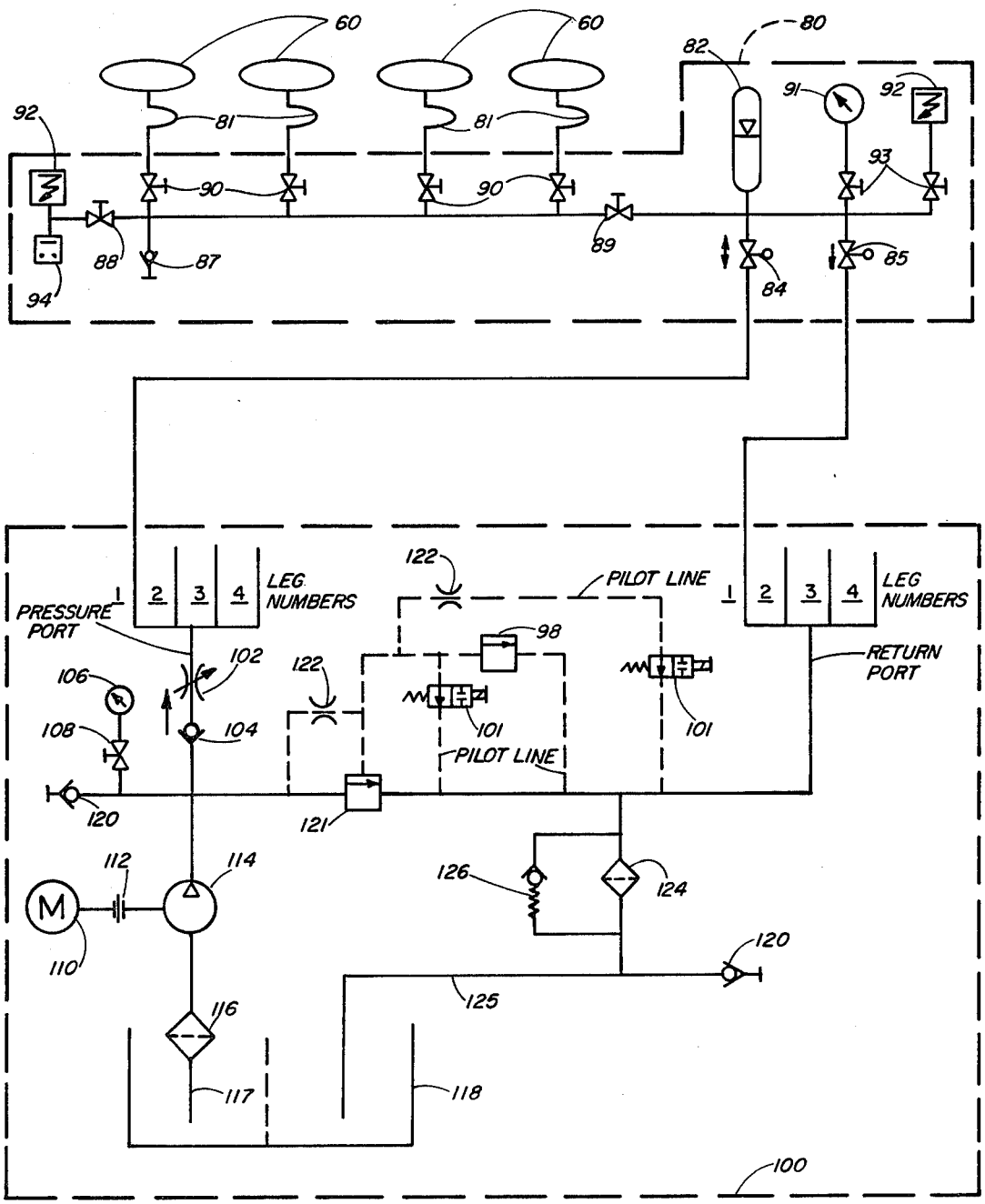
FIG. 9 is a schematic instrumentation drawing of the preferred embodiment of the apparatus of the present invention.

FIG. 9 provides a schematic view of the preferred embodiment of the apparatus of the present invention. In FIG. 9 there can be seen a plurality of pads 60 each of which is connected by means of a flexible connection 81 to hydraulic pad sub-system 80. In the drawings notice the use of the numerals 1 through 4 which indicate that four hydraulic systems 80 would be supplied with each jacking structure, for example, with a rig having four movable legs. For purposes of illustration, however, only one subsystem 80 is shown as used with hydraulic leg No. 1.

Each pad 60 is supplied through flexible hose 81, with hydraulic fluid and can be valved by valves 90. Valve 89 is placed in a hydraulic line receiving hydraulic fluid under pressure from accumulator 82 which can then be valved with all hydraulic pads at the same time thereby providing a spring response, of the hydraulic pad plus accumulator unit. This can be adopted for a wide range of shock absortion or vibration dampening. Each pad 60 on an individual basis can be valved such as in the event of damage to one unit, for example, with that particular pad 60 being isolated to facilitate maintenance.

A pressure transducer 92 and low pressure sensor 94 are also provided as connected through valve 88 to the hydraulic line supplying fluid to each pad 60.

Pressure gauge 91 and pressure transducer 92 are provided and can be isolated from the system by means of needle valves 93.

Valves 84, 85 could be, for example, ball valves while 87 represents a pressure probe.

A typical hydraulic power unit 100 is provided with components as follows:

101—pilot solenoid
102—flow control valve
104—check
106—pressure gauge
108—needle valve
110—motor
112—coupling
114—hydraulic pump
116—strainer
117—pipe, suction
118—tank
120—quick disconnect for pressure check
121—pilot operated pressure relief valve
122—calibrated orifice
124—return filter
125—return line
126—bypass check valve.

The functions of the hydraulic power unit are to pressure the hydraulic pads up to their preload force of, for example, a 120 tons and to pressurize the hydraulic pads up to 180 percent of the nominal load for preloading the legs of the barge.

The fluid used in the hydraulic system can be, for example, a water-glycol fluid such as "Houghto Safe 620", or the like.

In working conditions, the four hydraulic pads associated with each particular leg are interconnected. Consequently, they have the same internal pressure, and generally carry the same load.

This makes the load of each particular leg equally shared among its four "three pinion" jacking units, for example. The accumulator 82 is, for example, a bladder pressure accumulator.

When the platform barge 16 portion is afloat with legs 14 in the upper position, the legs 14 are then lowered down to the seabed and this vertical motion of the barge can induce shocks between one leg and the seabed. This shock is transmitted to the barge through the leg, the racks, the pinions P of jacking units 30 and the upper solid rubber pad 32 and thence to hydraulic pad assemblies 10. Since the hydraulic pads 60 of each leg 14 are connected to pressure accumulator 82, the shock will cause the hydraulic fluid to be driven out from the interior 64 of hydraulic pads 60 to pressure accumulator 82. Consequently, the gas within the pressure accumulator will become compressed and its compression will participate in absorbing the shock. When the shock load disappears, the compressed gas within the accumulator then pushes the hydraulic fluid back into the hydraulic pads. This shock absorbing capability is also helpful when starting the electric motors of the jacking units, a smoother strating sequence is obtained, and the nominal speed is quickly reached.

With regard to load monitoring, when the barge is jacked up, its weight is transmitted to the seabed through the hydraulic pads 60. In this situation, the pads 60 are slightly compressed, and consequently the lower solid rubber pads 32 do not contact the jacking units. The force is thus transmitted by each hydraulic pad 60 dependent upon two factors: (1) its internal pressure, and (2) its thickness (because its contact surface decreases when the thickness increases). In the normal range of operation the thickness variation can be neglected, after careful calibration of the readout, the resultant error being negligible.

The load carried by each of the legs can be determined once the pressure readout within the pad is determined.

A barge 16 with four legs is statically indeterminate the weight of the barge will not be equally shared among its four legs. For example, one or two legs can be appreciately overloaded as compared with the remaining legs. In such a situation, the intrconnection between the hydraulic lines of two adjacent legs will equalize the pressure respectively in the hydraulic pad 60 of these two legs and consequently equalize the reactions of these two legs in question with a similar effect on the other two remaining legs. Moreover, any change of weight distribution afterward will be shared among the legs as the platform as a whole is now statically determinate.

When the barge 16 has been jacked up, it is required that each leg 14 be preloaded quite generally up to 180 percent of its nominal load on the site. The usual way to achieve this is to increase the weight of the barge by adding water ballast.

Another way is to use the hydraulic pads to overload two diagonally opposed legs 14 by reducing the load on the other two legs.

This operation is carried out by releasing the pressurized fluid in the interior 64 of hydraulic pads 60 of two diagonally opposed legs 14, the other two diagonally opposed legs 14 will be preloaded simultaneously.

The starting operation of the system should be made before each elevation of the barge in order to put the installation in a balanced and known condition. This operation is quick and easy. After a long period of time with the barge jacked up, a loss of hydraulic fluid can be experienced. This will be noticed by observing the pressure of each of the four hydraulic pads, and any leakage occurring for one of the legs will modify the equalibrium in the barge consequently the share of the load among the legs will be modified. The lower pressure sensor of each panel would give an alarm if the leakage had not been noticed before.

With the present invention, the quantity of fluid in anyone of the hydraulic accumulators can be adjusted with the barge jacked up. For this operation the hydraulic pads 60 of the leg in question are isolated from their pressure accumulator by closing valves 89, then the fluid quantity is modified in each accumulator by first dumping all the fluid in the accumulators by opening the valves 85 then closing the same valves 85 and starting the pumping unit and opening the valves 84. The hydraulic fluid is pumped into the accumulators by energizing one of the electro-directional valves 101 until the desired pressure is reached inside the accumulators. Then the valves 84 are closed and the valve 89 is opened. This procedure prevents dumping fluid from the hydraulic pads to the tank and allows making a fine readjustment of the spring response, thus giving shock absorbing and dampening capabilities.

The present invention thus provides a load transfer and monitoring system for jackup rigs which can determine the platform or barge weight and the horizontal position of the center of gravity on the platform. This is achieved by utilization of the pressure gauges and pressure transducers which monitor the pressure and resultant load information carried by a particular leg. Because of the use of a relatively frictionless hydraulic component in the form of the hydraulic pads, a source of error in monitoring is quite small, on the order of two to five percent.

The present invention further provides as above-described a sharing of the load between the different legs in jackup platforms having four or more legs. This is done by mechanically reducing the four legs to three by placing any two of the legs on the same circuit which would equalize the load carried by the two legs, thus reducing the four-leg jackup barge to a statically determinate three-leg structure.

The present invention as above-described provides a means of preloading the legs of the platform of the jackup rig where four or more legs are involved. This would entail a reduction of the pressure in the pads associated with two of the legs which would thus place more load on the other two remaining legs of the jackup barge preloading them without the use of ballast and without adding any weight to the platform such as live load or variable load.

By monitoring continuously the pressure in the various hydraulic pads, the jackup platform operator can be warned of overloading on any one of the platform legs by simply using an alarm, for example, which could sound at any desired load value which would be a load limit. Such a high value might be experienced, for example, during high waves, heavy wind, or added external force applied, for example, by a tug or other vessel pushing against the structure. It might also occur by adding extraneous live load or variable load to the structure.

The present invention lends itself to load monitoring and load transfer, more particularly in that it is not disturbed with shear loads which are generated between the legs of the platform and the jacking structures such as is the case in the use of hydraulic cylinders where shear increases frictional wear and tear between the piston and rod and other portions of the hydraulic cylinder assemblies.

Because many varying and different embodiments may be made within the scope of the invention concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A load transfer apparatus for jackup barges, comprising:

a. a barge structure;

b. at least three legs movably attached to the barge structure;

c. a plurality of jacking mechanism means associated respectively with each of the legs for vertically moving each of the legs with respect to the barge structure;

d. pad means associated with each of the jacking structure means and placed between the jacking mechanism means and the barge for forming a load transfer interface between the jacking mechanism means and the barge transmitting the leg loads to the barge structure, the pad means comprising at least in part an inflatable pad having a hollow interior defined by an outer expandable wall for containing hydraulic fluid; and e. conduit means penetrating the pad wall for transmitting hydraulic fluid to the hydraulic pad interior.

2. The apparatus of claim 1 wherein said pad is pressurizable.

3. The apparatus of claim 1 further comprising accumulator means for modifying the spring response of said pad.

4. The apparatus of claim 1 wherein said jacking mechanism means comprises a structural frame surrounding a portion of said leg at the deck of said barge, a rack on said leg, a motor assembly drivingly supporting said rack, said motor assembly being structurally connected to said barge, load normally transferring from said leg through said rack to said motor assembly to said frame and said barge, and said pad occupies a position between said jacking assembly and said structural frame.

5. The apparatus of claim 1 wherein each of said pad means are each hydraulically separable from one another.

6. The apparatus of claim 1 further comprising means for determining hydraulic pressure within said inflatable pad during operation.

7. The apparatus of claim 4 wherein said structural frame comprises one or more side walls terminating at their lower edge on the deck of said barge and at their upper edge at a provided horizontally disposed ring beam, together defining therewithin a housing about said jacking assembly, and said pad occupies a position atop said jacking assembly and below said ring beam abutting said ring beam and said jacking assembly on its top and bottom surfaces respectively.

8. The apparatus of claim 1 wherein said pad means comprises:

a hollow steel reinforced rubber pad;

a laterally rigid enclosure surrounding said pad, allowing said pad to dimensionally enlarge in a direction generally coaxial with said leg;

hydraulic line means attached to said pad for inflating said pad.

9. The apparatus of claim 8 wherein said enclosure comprises a pair of telescoping enclosure halves movably disposed with respect to one another, said enclosure halves each providing generally horizontal bearing surface portions for engaging respectively said jacking assembly and said structural frame.

10. The apparatus of claim 9 wherein said bearing surfaces are rectangular, each providing peripheral skirts depending therefrom in a generally vertical direction, said skirts of said respective enclosure halves each being disposed adjacent one another to allow relative telescopic motion of said halves, at least one of said skirts providing lateral stability for said pad during pressurization thereof.

11. The apparatus of claim 9 wherein said enclosure halves move apart/together responsive to inflation/deflation respectively of said pad.

12. The apparatus of claim 8 wherein said hollow rubber pad is partially filled with a plurality of beads.

13. The apparatus of claim 12 wherein said beads limit the collapse of said pad.

14. The apparatus of claim 12 further comprising means for determining the hydraulic pressure within said inflatable pad during operation.

15. The apparatus of claim 12 wherein said inflatable pad is normally filled with hydraulic fluid, and there is further provided a line connecting said pad with a provided pressure accumulator, and said accumulator is filled in part with hydraulic fluid and in part with a gaseous medium, with said gaseous medium compressing responsive to load applied to said hydraulic pad forcing hydraulic fluid from said pad through line into said accumulator, thus absorbing shock transmitted to said pad.

16. The apparatus of claim 12 wherein said inflatable interface means comprises a plurality of inflatable pads each independently separable hydraulically from the other.

17. The apparatus of claim 12 wherein said frame comprises a jacking house associated respectively with each of the legs and surrounding generally each of the legs at the barge deck surface.

18. The load transfer apparatus of claim 12 wherein there is further provided a pressure gauge hydraulically connectable to said inflatable interface means for reading the hydraulic pressure within said inflatable pad.

19. The load transfer apparatus of claim 12 wherein said inflatable interface means comprises at least in part an inflatable pad having a hollow interior filled during operation with hydraulic fluid and there is further provided a spigot on said pad with a conduit connected thereto allowing hydraulic fluid to be transmitted into/discharged from said pad responsive to expansion and contraction of said pad.

20. The apparatus of claim 19 wherein said conduit is connected to a pressure accumulator.

21. The apparatus of claim 12 wherein further comprising hydraulic drive means for inflating said pad with hydraulic fluid, said drive means comprising at least in part a powered pump.

22. The apparatus of claim 12 wherein said inflatable interface means comprises at least in part a plurality of inflatable pads associated respectively with each of said legs, each of said pads having associated therewith a hydraulic sub-system for inflating/deflating each of said pads respectively and independently of one another, said hydraulic sub-system including at least in part a pressure accumulator separately connectable to each of said hydraulic pads, a pressure gauge connectable hydraulically to each of said hydraulic pads for determining the pressure therewithin, and a powered hydraulic pump for supplying hydraulic fluid under pressure to the interior of said hydraulic pads.

23. A load transfer apparatus for jackup barges comprising:

a. a barge supported by a plurality of legs movably attached thereto;

b. jackup means on the barge and associated with each of the legs for raising and lowering the barge on the legs when the legs engage the seabed at their lower ends;

c. load transfer means interfaced between the barge and the jackup means for absorbing shock between the jackup means and the barge, the load transfer means comprising:

i. a structural frame;

ii. a jacking assembly mounted to the frame, operation of the jacking assembly vertically raising/lowering the barge with respect to the leg; and iii. inflatable interface means mounted on the barge between the jacking assembly and the structural frame, the inflatable interface means comprising at least in part an inflatable pad having a flexible wall allowing the pad to expand/contract in both vertical and horizontal directions; and d. an accumulator hydraulically attachable to the inflatable pad.

24. The apparatus of claim 23 wherein said accumulator is hydraulically separable from said pad.

25. A load transfer/monitoring apparatus for jackup barges comprising:

a. a barge;

b. at least three load carrying legs movably attached to the barge;

c. jack up means on the barge and associated with each of the legs for raising and lowering the barge on the legs when the legs engage the seabed at their lower ends;

d. substantially frictionless expansible hydraulic component means associated respectively with each of the legs and the jack up means for providing load value information of the load carried by each of the legs, the component means including:

i. a hydraulically, inflatable pad having a hollow interior defined by an outer expandable wall;

ii. conduit means penetrating the pad wall for transmitting hydraulic fluid to the pad interior, the conduit including means for connecting a pressure monitor thereto for determining the hydraulic fluid pressure of the hydraulic fluid in the pad; and iii. an outer enclosure which surrounds the pad including a pair of structurally reinforced enclosure halves which can move apart/together responsive to expansion/contraction of the inflatable pad respectively.

26. The apparatus of claim 25 wherein said component means comprises in part a hollow pad having an inner void space of variable volume.

27. The apparatus of claim 26 wherein said hollow pad provides a flexible continuous wall.

28. The apparatus of claim 27 wherein said hollow pad is comprised in part of a rubber material.

29. The apparatus of claim 25 wherein said component means comprises in part a network of interconnecting hydraulic lines and a plurality of pressure gauges associated respectively with said plurality of legs.

30. A load transfer apparatus for jackup barges comprising:

a. a barge;

b. at least three load carrying legs, each movably affixed to the barge;

c. at least one jacking mechanism associated with each of the legs for moving the leg with respect to the barge;

d. hydraulic fluid containing component means interfaced between the barge and the leg for transferring load between the barge and the leg with a responsive increase in hydraulic fluid pressure; and e. means for distributing substantially the entire load to any two of the jacking mechanisms and associated hydraulic means so that any two of the legs can be preloaded, the distributing means including means for independently increasing/decreasing the hydraulic fluid pressure of any one of the hydraulic fluid containing component means.

31. The apparatus of claim 30 wherein the hydraulic means comprises in part an expansible pad having a hollow interior which contains hydraulic fluid.

32. The apparatus of claim 31 wherein said pad is of rubber-like material.

* * * * *